US007296579B2

(12) United States Patent
Focke et al.

(10) Patent No.: US 7,296,579 B2
(45) Date of Patent: Nov. 20, 2007

(54) METHOD AND DEVICE FOR PRODUCING FILTER CIGARETTES

(75) Inventors: Heinz Focke, Verden (DE); Frank Beckmann, Aumühle (DE); Christina Kunig, Hamburg (DE)

(73) Assignee: Focke & Co. (GmbH & Co.), Verden (DE)

( * ) Notice: Subject to any disclaimer, the term of this patent is extended or adjusted under 35 U.S.C. 154(b) by 514 days.

(21) Appl. No.: 10/495,182

(22) PCT Filed: Nov. 9, 2002

(86) PCT No.: PCT/EP02/12546

§ 371 (c)(1),
(2), (4) Date: May 11, 2004

(87) PCT Pub. No.: WO03/043449

PCT Pub. Date: May 30, 2003

(65) Prior Publication Data

US 2004/0255963 A1 Dec. 23, 2004

(30) Foreign Application Priority Data

Nov. 19, 2001 (DE) ..... 101 56 303

(51) Int. Cl.
*A24C 5/47* (2006.01)

(52) U.S. Cl. ..... 131/94

(58) Field of Classification Search ..... 131/76, 131/29, 32, 33, 57.5, 94
See application file for complete search history.

(56) References Cited

U.S. PATENT DOCUMENTS 1,824,414 A * 9/1931 Stein ..... 198/456
3,036,581 A * 5/1962 Dearsley ..... 131/94
4,531,629 A * 7/1985 Seragnoli et al. ..... 198/458
5,425,383 A * 6/1995 Garthaffner et al. ..... 131/94

FOREIGN PATENT DOCUMENTS

DE 28 09 619 C2 5/1986

(Continued)

OTHER PUBLICATIONS

German Language Copy of German Patent Office search report dated Aug. 6, 2002.

(Continued)

*Primary Examiner*—Steven P. Griffin
*Assistant Examiner*—John B. Edel
(74) *Attorney, Agent, or Firm*—Laurence P. Colton; Smith, Gambrell & Russell

(57) ABSTRACT

In the production of filter-tipped cigarettes (25), an apparatus (filter attachment machine) is used, which consists of a main cylinder (10) and a plurality of assigned further cylinders. The elements of the filter-tipped cigarettes (25), specifically a tobacco rod (15) or part-rods (16, 17), filter pieces (21), cigarette units (23), and the filter-tipped cigarettes (25) produced therefrom are transported by the main cylinder (10), with the exception that part-rods (16, 17) displaced at a distance from one another and with a filter piece (21) inserted for the attachment of a wrapping paper (22) are transported and connected to one another outside the main cylinder (10), so that one-piece cigarette units (23) are returned to the main cylinder (10).

19 Claims, 7 Drawing Sheets

FOREIGN PATENT DOCUMENTS

| | | | |
|---|---|---|---|
| DE | 26 55 790 | C2 | 4/1988 |
| DE | 42 42 326 | A1 | 6/1993 |
| EP | 1 013 181 | A | 6/2000 |
| EP | 1 108 369 | A | 6/2001 |
| EP | 1 138 215 | A | 10/2001 |
| JP | 7-265051 | | 10/1995 |
| JP | 2000-189137 | | 7/2000 |

OTHER PUBLICATIONS

Japanese Office Action dated Sep. 21, 2006.

* cited by examiner

METHOD AND DEVICE FOR PRODUCING FILTER CIGARETTES

BACKGROUND OF THE INVENTION

1. Technical Field

The invention relates to a method for the production of filter-tipped cigarettes from tobacco rods, which are severed centrally during transportation to produce part-rods, the part-rods being moved apart, and being connected by means of wrapping paper to a filter piece and cigarette units thus formed being severed centrally in the region of the filter piece. The invention also relates to an apparatus for carrying out the method.

2. Prior Art

The production or finishing of filter-tipped cigarettes takes place in the area of a filter attachment machine. The latter comprises a number of cylinders with troughs arranged on the circumference. The abovementioned process steps for the production of the filter-tipped cigarettes are performed in the area of these troughed cylinders.

BRIEF SUMMARY OF THE INVENTION

It is an object of the present invention to improve the production of filter-tipped cigarettes in the area of the filter attachment machine by simplifying the design of the said machine and by increasing output.

In order to achieve this object, the method according to the invention is characterized by the following features:

a) the tobacco rods or the part-rods are fed to a main cylinder and transported by the latter, b) the part-rods are moved to a distance apart from one another by axial displacement during transportation on the main cylinder, c) filter pieces are fed to the main cylinder by a filter cylinder disposed adjacently to the main cylinder and are inserted into a gap formed between the part-rods, d) the (two) mutually assigned part-rods, each with one filter piece, are removed from the main cylinder and transported outside the region thereof, during which they are joined together and connected to one another by means of wrapping paper, and e) cigarette units thus formed are returned to the main cylinder and, during further transportation on the main cylinder, are severed centrally in the region of the filter pieces to form filter-tipped cigarettes.

In accordance with this method according to the invention, the central main cylinder is the conveyor member for the parts of the filter-tipped cigarettes until the completion thereof, with the proviso that the joining of the tobacco rods to, in each case, one (double-length) filter piece takes place outside the area of the main cylinder.

The apparatus according to the invention for the production of filter-tipped cigarettes comprises, in the area of the main cylinder, supports for a number of troughs, specifically segments or sliding segments. These can be moved with the troughs and the tobacco rods or filter-tipped cigarettes disposed therein in a direction parallel to the axis, in particular moved apart, in order to move parts of the filter-tipped cigarettes or pairs of filter-tipped cigarettes to a distance apart from one another. Therefore, according to the invention, every two coinciding sliding segments are assigned to one another in the axial direction of the main drum and can be moved (simultaneously) in one or other direction parallel to the axis. The entire circumference, or a shell, of the main cylinder consists of such sliding segments, in each case having a number of troughs to receive the parts of the filter-tipped cigarettes.

An important special feature resides in measures for the simple adjustment of the apparatus, specifically of the main cylinder in particular, for the production of filter-tipped cigarettes of different dimensions, especially with filters or filter pieces of different lengths.

Adjustment to such changes of format takes place, according to the invention, by a simple adjustment of members or the insertion of spacers, stops or the like, which—independently of predetermined amplitudes of movement of the sliding segments—determine the gap to be created between two mutually assigned tobacco rods in accordance with the length of the filter piece to be inserted.

BRIEF DESCRIPTION OF THE DRAWINGS

Further advantages and special features of the invention are explained in detail below with reference to an example of embodiment of the apparatus. In the drawings.

DETAILED DESCRIPTION OF THE PREFERRED EMBODIMENTS

Figure 1:
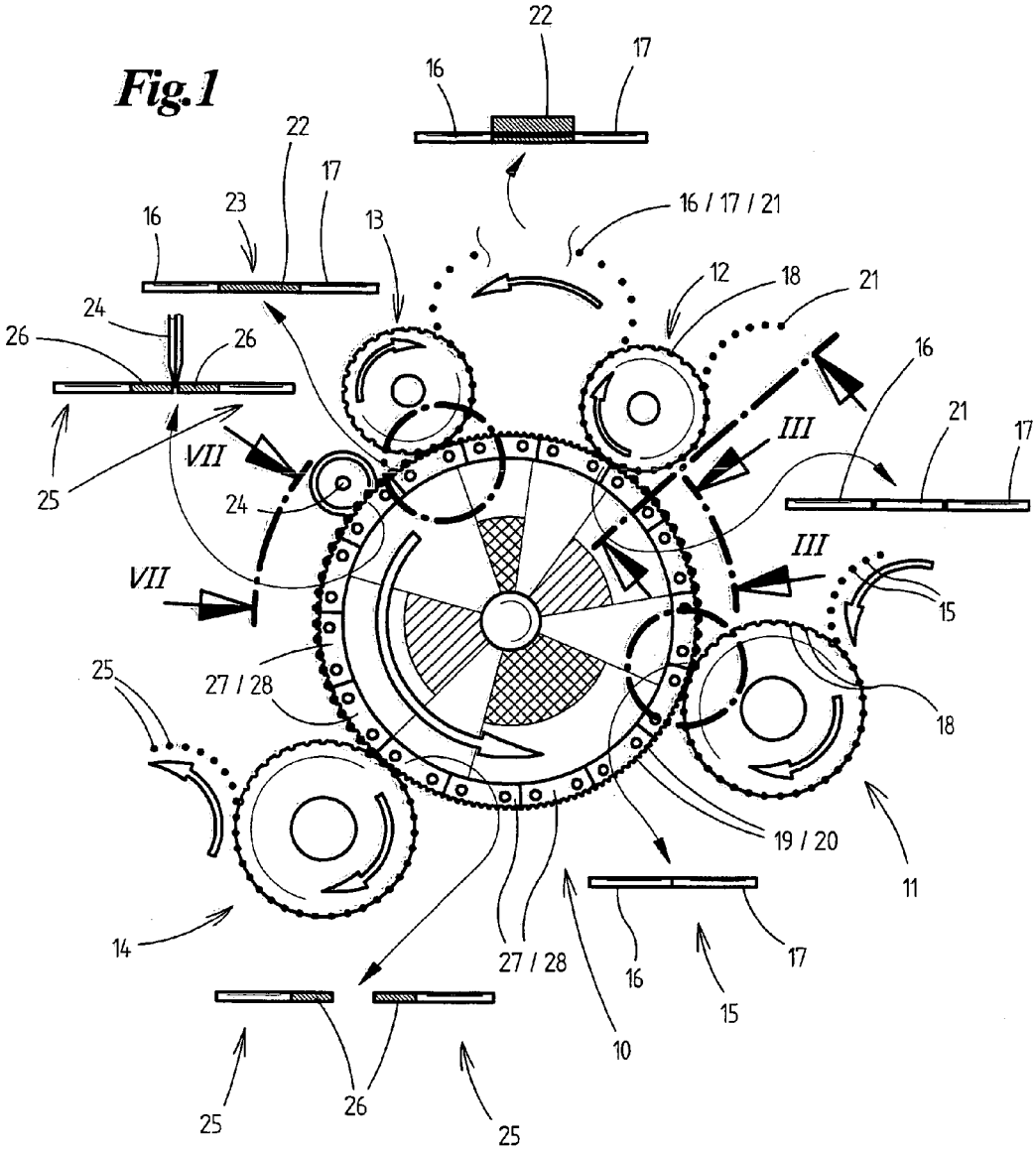
FIG. 1 shows a part-area of the apparatus with a main cylinder in a diagrammatic lateral view.

The apparatus diagrammatically shown in FIG. 1 forms part of a cigarette production machine. The central element is a main cylinder 10. Assigned to this are a plurality of secondary cylinders, which lead, in a direction parallel to the axis, to the circumference of the main cylinder 10. They are a feed cylinder 11, a filter cylinder 12, a return cylinder 13 and a removal cylinder 14. The individual production phases are shown symbolically and assigned to the appropriate areas of the main cylinder 10 and/or other conveying members.

According to the illustration, tobacco rods 15 cut from a tobacco tow are passed to the main cylinder 10 by the feed cylinder 11. In the present example of embodiment, the tobacco rods 15 have already been severed centrally in a previous working stroke, two part-rods 16, 17 of the same length being formed. These are initially transported in troughs 18 of the feed cylinder 11 and then received by troughs of the main cylinder 10, specifically segment troughs 19, 20.

Figure 5:
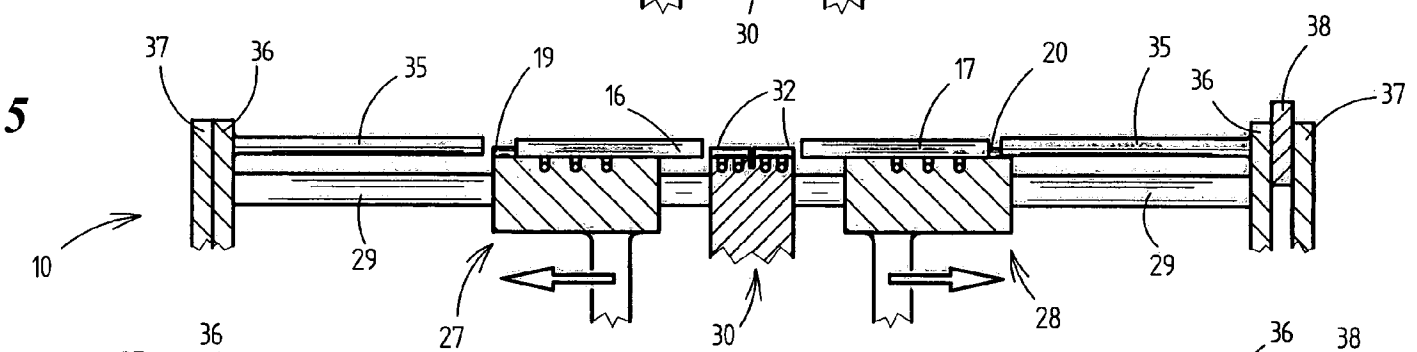
FIG. 5 shows a view analogous to FIG. 4, with offset members, corresponding to the plane of section V-V in FIG. 3.
Figure 6:
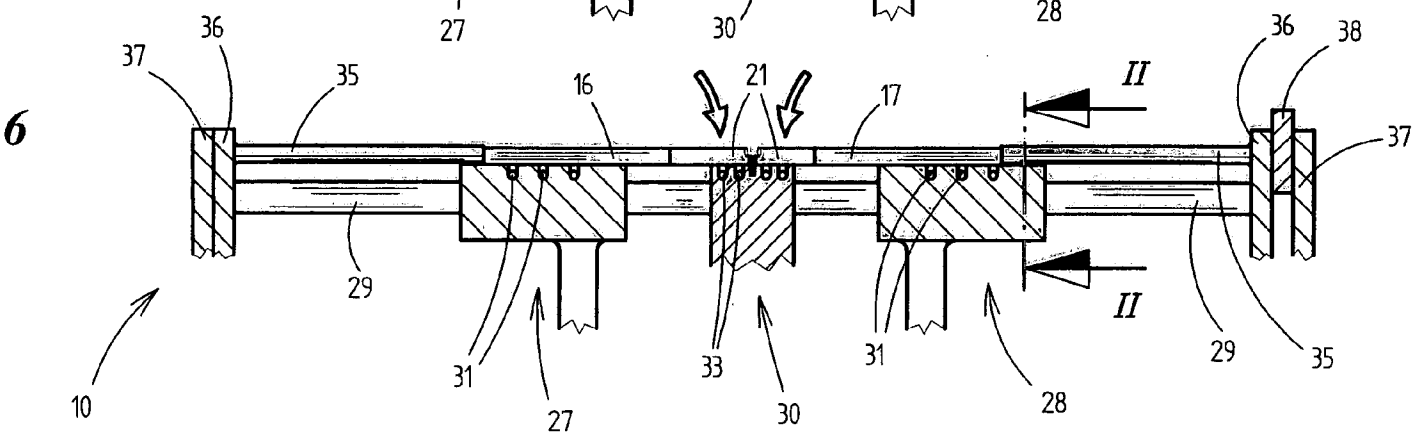
FIG. 6 shows a further view analogous to FIG. 4 and FIG. 5, specifically in the plane of section VI-VI in FIG. 3.

During the transportation of the tobacco rods 15 by the main cylinder 10 to the filter cylinder 12, the part-rods 16, 17 are moved apart in the axial direction, forming a gap between the two part-rods 16, 17 (FIG. 5, FIG. 6). A (double-length) filter piece 21 is inserted into this gap. This is prepared separately and fed in by the filter cylinder 12, which is likewise equipped with troughs 18, to the circumference of the main cylinder 10.

A special feature of the apparatus resides in the fact that it is only in the region where the main cylinder 10 and filter cylinder 12 are adjacent that the filter pieces 21 enter the segment troughs 19, 20 of the main cylinder 10. Immediately thereafter, the filter cylinder 12 again picks up each pair of mutually assigned part-rods 16, 17, together with a filter piece 21, from the main cylinder 10, and transports these parts until they are delivered to a conveyor (not shown in detail). In the region of the latter, the part-rods 16, 17 are initially brought into contact with the assigned filter piece 21. Thereafter, during transportation outside the main cylinder 10, the connection between these elements is formed, this being done by a wrapping paper 22, which is laid around the parts to be connected to one another. The cigarette units 23 thus formed are conveyed back by the return cylinder into the main cylinder 10 and laid down in the segment troughs 19, 20.

During the transportation of the cigarette units 23 on the main cylinder 10, which now follows, a severing cut is made centrally in the region of the filter pieces 21, this being done by a severing blade 24 assigned to the main cylinder 10. As a result, (finished) filter-tipped cigarettes 25 are formed, with filters 26 facing one another. The filter-tipped cigarettes 25 are transported onwards—the distance between them being increased—by the main cylinder 10 to the removal cylinder 14, which takes over and removes the filter-tipped cigarettes 25 in pairs. The emptied segment troughs 19, 20 are now free to receive the tobacco rods 15.

The main cylinder 10 is configured in a special manner, specifically with supports for the troughs, these being sliding segments 27, 28, disposed on the outer circumference, movable parallel to the axis and assigned to one another in pairs. The sliding segments are displaceably mounted on support bars 29 and are controlled, in particular, by cams disposed within the main cylinder 10.

A circumferential segment ring 30 is attached as an immovable member between the mutually assigned sliding segments 27, 28. The support bars 29 are connected to the segment ring 30.

The sliding segments 27, 28 comprise a number of segment troughs 19, 20 disposed side by side at a short distance apart from one another and oriented in the same direction. The segment troughs 19, 20 contain drilled holes 31, which are connected to a vacuum source, so that a vacuum prevails in the troughs or segment troughs 19, 20 to secure the tobacco rods 15 and cigarette units 23 or filter-tipped cigarettes 25. The segment troughs 19, 20 are continued by annular troughs 32 in the segment ring 30. When sliding segments 27, 28 lie against the segment ring 30, continuous troughs (FIG. 3, bottom) are formed, for example to receive tobacco rods 15 or part-rods 16, 17. The annular troughs 32 are also provided with drilled holes 33 which are connected to a vacuum source and—independently of the drilled holes 31—can be subjected to the action of suction air.

The filter pieces 21 are laid against the circumference of the main cylinder 10 in the region of the segment ring 30 and are fixed. The severing cut is additionally made in the region of the segment ring 30 by the severing blade 24. For this purpose, the segment ring 30 has a central groove 34 into which the severing blade 24 enters when performing the severing cut.

Figure 7:
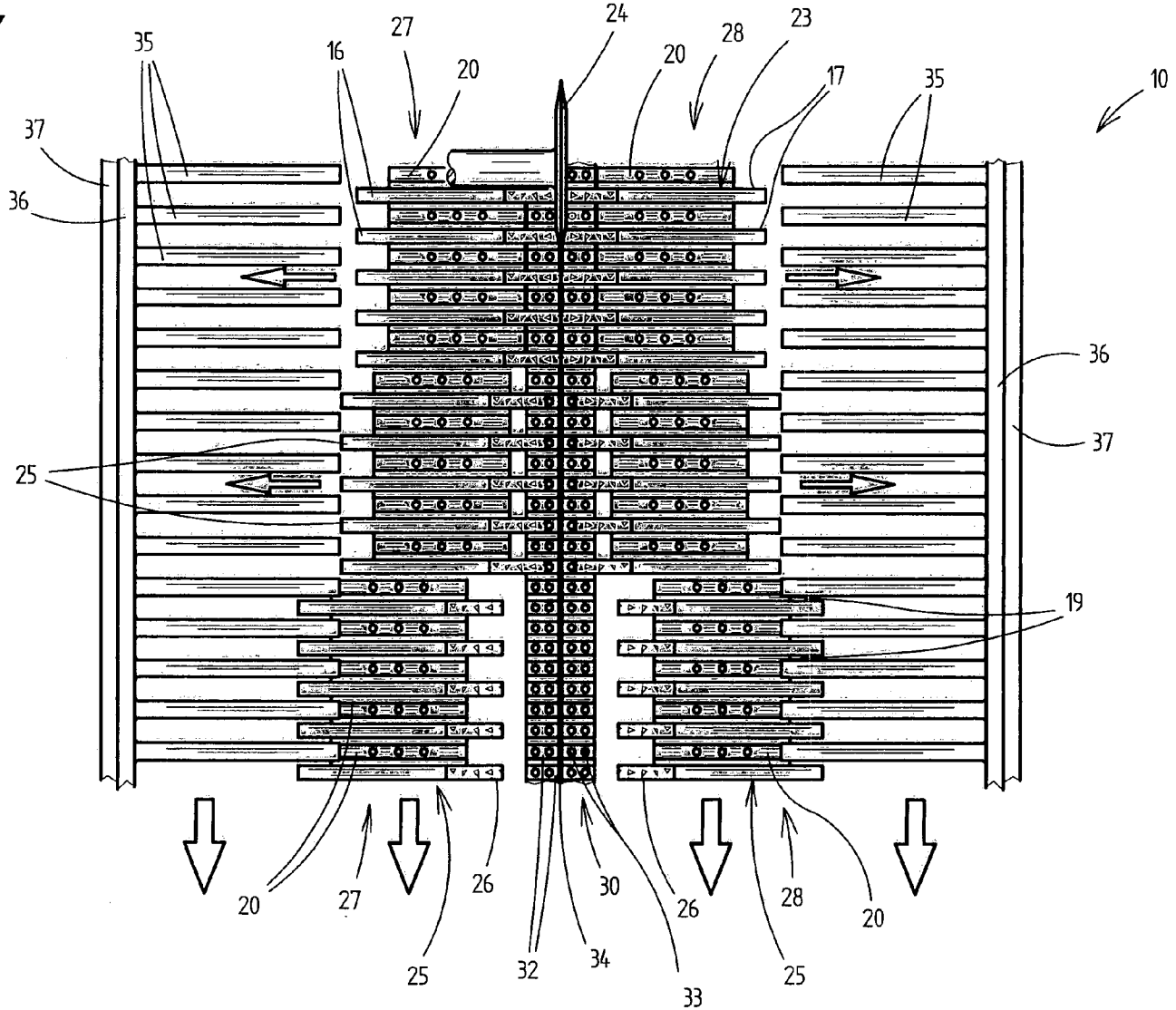
FIG. 7 shows a view analogous to FIG. 3 for another circumferential area of the main cylinder corresponding to the line of sight VII-VII in FIG. 1, FIG. 8*a* to FIG. 13*b* show different positions of trough supports or sliding segments of the main cylinder in radial section, in each case comparing filter-tipped cigarettes with filters of different lengths and a symbolic representation of the current phase of production, in the region of the main cylinder.

The sliding segments 27, 28 permit the displacement (by groups) of elements for the production of the filter-tipped cigarettes 25, specifically, first the movement apart of the part-rods 16, 17 (FIG. 3) and then the movement apart of the filter-tipped cigarettes (FIG. 7). The distance of the sliding segments 27, 28 from one another determines the gap between the part-rods 16, 17 and the filter-tipped cigarettes 25.

A special feature resides in the fact that, during the transportation of the part-rods 16 and 17 with filter piece 21 and of the formed cigarette units 23 outside the area of the main cylinder 10, specifically above the latter, the moved-apart sliding segments 27 are moved back again to a lesser distance apart from one another or until they rest upon the segment ring 30, in other words in the position shown in FIG. 7, top. In this position, the finished cigarette units 23 can again be laid on the sliding segments 27, 28.

A special feature is the adaptability of the apparatus to different dimensions of the filter pieces 21 or filters 26, or of the part-rods 16, 17, without any retooling of the main cylinder or of a transmission. In the example of embodiment shown in FIG. 1 to FIG. 7, the procedure followed is that the parts resting in the segment troughs 19, 20, especially part-rods 16, 17, are moved against stops which determine the relative position in accordance with the respective dimensions of the processed elements. The sliding segments 27, 28 are set by gearing to a format-independent amplitude of movement. This corresponds to a maximum dimension of filter-tipped cigarettes 25. The parts resting in the segment troughs 19, 20 are stopped by adjustable spacers at the correct position for the format, irrespective of the movement of the sliding segments 27, 28.

Figure 3:
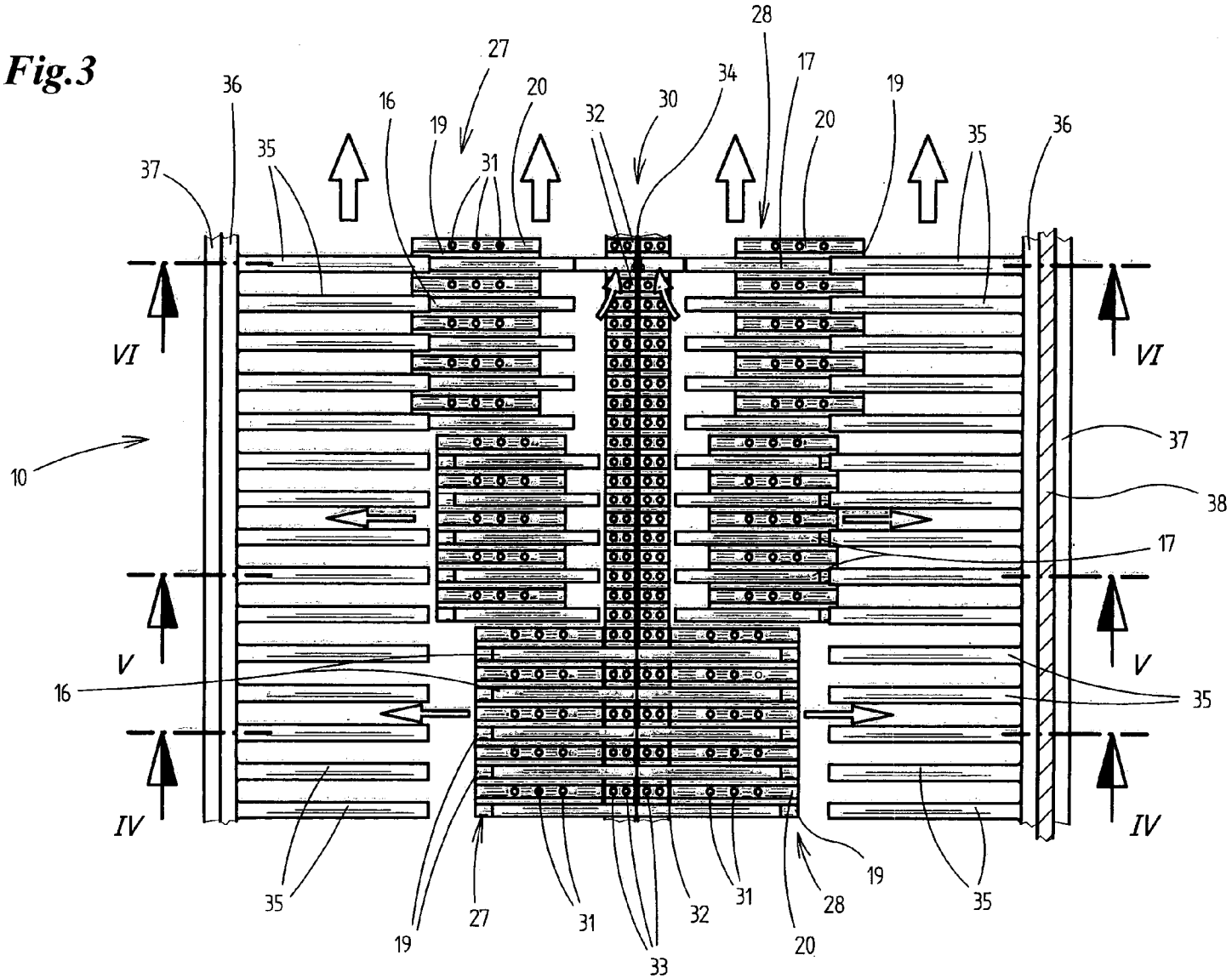
FIG. 3 shows a circumferential region of the main cylinder in a radial plan view, III-III in FIG. 1, on a larger scale.
Figure 4:
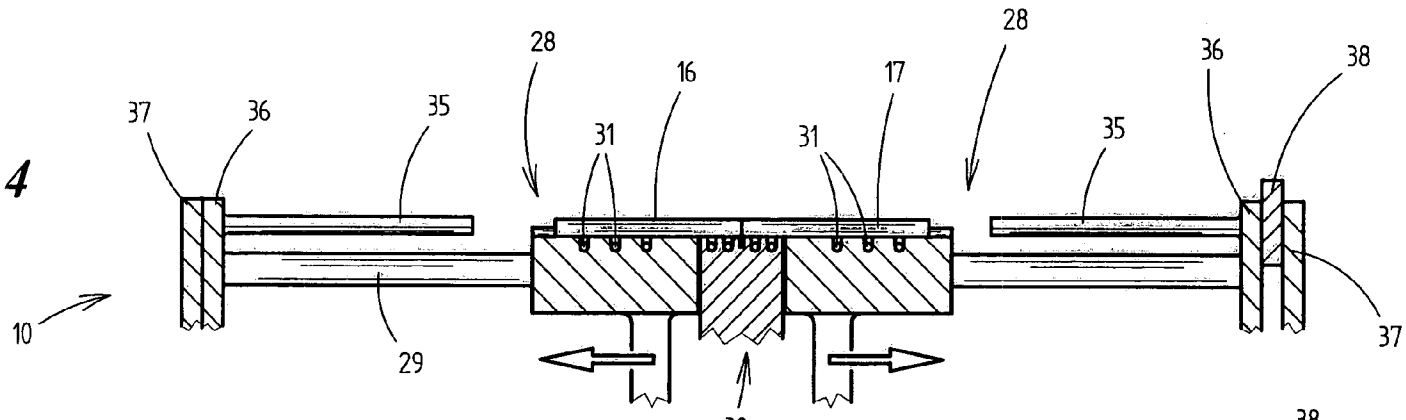
FIG. 4 shows a transverse or radial section in the plane of section IV-IV in FIG. 3.

The spacers in this example of embodiment are (cylindrical) spacer bolts 35, which enter from both sides into the troughs, specifically segment troughs 19, 20, of the sliding segments 27, 28. The spacer bolts 35, of equal length and disposed on both sides of the main cylinder 10, lie with their axes aligned with the axes of the segment troughs 19 and, on movement of the sliding segments 27, 28 outwards, enter into these segment troughs 19. End surfaces of the part-rods 16, 17 run against the ends of the spacer bolts 35 and are held in the desired relative position when the sliding segments 27, 28 continue moving (FIG. 3, top). This position of the part-rods 16, 17 produces a gap formed between them in accordance with the length of the filter piece 21.

A format change is performed without replacement of the spacer bolts 35 themselves but by changing the relative position thereof in the direction parallel to the axis. For this purpose, the spacer bolts 35 are connected to support rings 36 on both sides of the main cylinder 10. These, in turn, are displaceably attached to outer fixed rings 37 as part of a support frame of the main cylinder 10. The support rings 36 can be adjusted. As a result of the insertion of a spacer 38 between support ring 36 and fixed ring 37, an axial displacement of the spacer bolts 35 takes place. FIG. 3, right, shows a position with shorter part-rods 16, 17 or shorter filter pieces 21, while FIG. 3, left, permits the longer embodiment, specifically larger gaps between the part-rods 16, 17.

The spacer bolts 35 cause interference in the region in which filter-tipped cigarettes 25 are being conveyed in the segment troughs 19, 20, because the filter-tipped cigarettes 25 have to be moved to a relatively long distance apart from one another (FIG. 7, bottom). For this purpose, the segment troughs 19, 20 of the main cylinder 10 are disposed at a short, minimal distance from one another, which corresponds to half the distance between the troughs 18 of the feed cylinder 11, filter cylinder 12, return cylinder 13 and removal cylinder 14. The relative position of the conveying members is selected to be such that the tobacco rods 15 or part-rods 16, 17 are laid in first segment troughs 19. Spacer bolts 35 disposed at the appropriate distance apart from one another are assigned to these first segment troughs 19. The second segment troughs 20 remain free in this region of the main cylinder 10 (FIG. 3). When the cigarette units 23 are returned to the main cylinder by the return cylinder 13, the relative position of the troughs 18 on the return cylinder 13 ensures that the cigarette units 23 are laid in the (second) segment troughs 20 (FIG. 7). These lie in the region between the spacer bolts 35.

Figure 15:
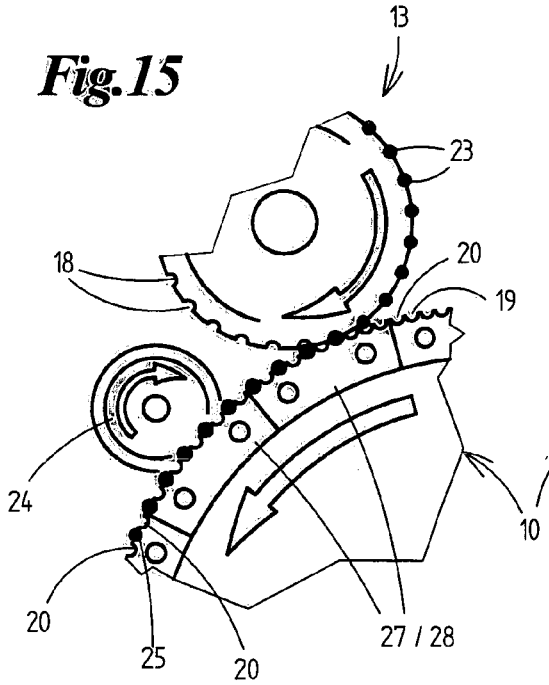
FIG. 14 to FIG. 17 show illustrations of areas in which tobacco rods on the one hand and cigarette units on the other are delivered to the main cylinder, FIG. 14 and FIG. 15 on the one hand and FIG. 16 and FIG. 17 on the other showing different embodiments.
Figure 14:
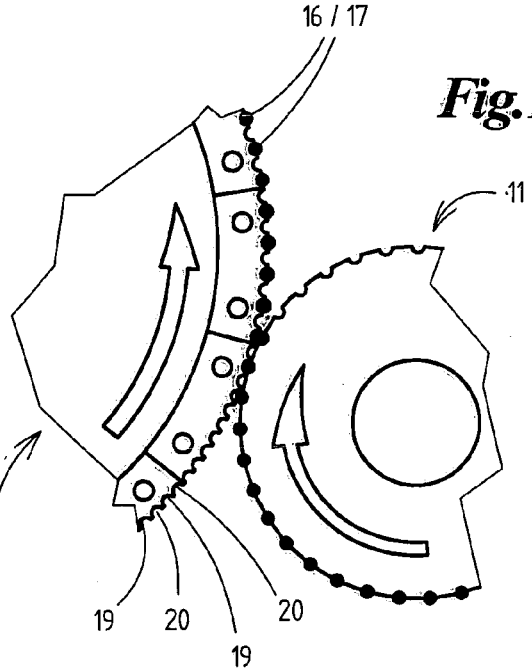

The operations described are also shown in FIG. 14 and FIG. 15. It can be seen that, in each case, only every second (segment) trough of the main cylinder 10 is charged by the feed cylinder 11 and the return cylinder 13.

Figure 2:
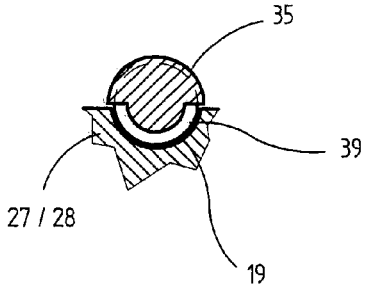
FIG. 2 shows a cross section through a detail in a plane of section II-II in FIG. 6, on a larger scale.

The spacer bolts 35 expediently have a particular cross section, which can be seen in FIG. 2. The spacer bolts 35 of round cross section have a larger cross section than corresponds to the diameter of the segment troughs 19, 20, to provide better support for the part-rods 16, 17. The lower cross-sectional region, which enters into the troughs, is provided with a semi-circular cut-out 39, so that the spacer bolts 35 extend within the troughs at a distance apart from the circular-surface-shaped bases of the troughs.

A special alternative for easier adaptability of the apparatus to different cigarette formats is shown in FIG. 8*a* to FIG. 13*b*. The aim here is to change the relative position of the sliding segments 27, 28 in their starting position, with the proviso that, with unchanged amplitudes of movement, different end positions of the sliding segments 27, 28 are obtained, with adaptation to the current cigarette format. The illustration in the drawing has been selected so that FIG. 8*a*, FIG. 9*a*, etc., each show comparative views of a sliding segment 27, 28 for cigarettes of different lengths in various positions, whereas FIG. 8*b*, FIG. 9*b*, etc. show diagrammatically the position on the main cylinder 10 corresponding to the selected position of the sliding segments 27, 28, in other words the current associated phase of production. The thick line here indicates the conveying path of the elements of the filter-tipped cigarettes 25 or of the cigarettes themselves. FIG. 8*a* to FIG. 10*a* show phases in the region between the feed cylinder 11 and the filter cylinder 12, while FIG. 11*a* to FIG. 13*a* refer to the production section following the return cylinder 13 as far as the provision of the sliding segments 27, 28 in the region of the feed cylinder 11.

The sliding segments 27, 28 can be controlled in respect of their movement by a control curve or control groove 40. A sensor member, specifically a roller 41, connected to the sliding segment 27, 28 enters into the control groove 40, drawn in a simplified style as a continuous track. The roller 41 is connected to the sliding segment 27, 28 via a push-and-pull member, specifically via a bar 42. The sliding segment 27, 28 is adjustable relative to the bar 42, for the purpose of creating a different starting position. To this end, as is shown diagrammatically, a head 43 connected to the bar 42 in a recess 44 of the sliding segment 27, 28 is adjustable, specifically against the loading of a spring, specifically a compression spring 45.

In the production of cigarettes of normal length, or with the conventional length of the filter piece 21, the compression spring 45 is relaxed. The head 43 lies against an end wall of the recess 44 (FIG. 8*a*, FIG. 9*a*, etc., bottom in each case). The sliding segments 27, 28, in the production of a cigarette of this type, lie against the fixed segment ring 30 in the starting position.

Figure 8A:
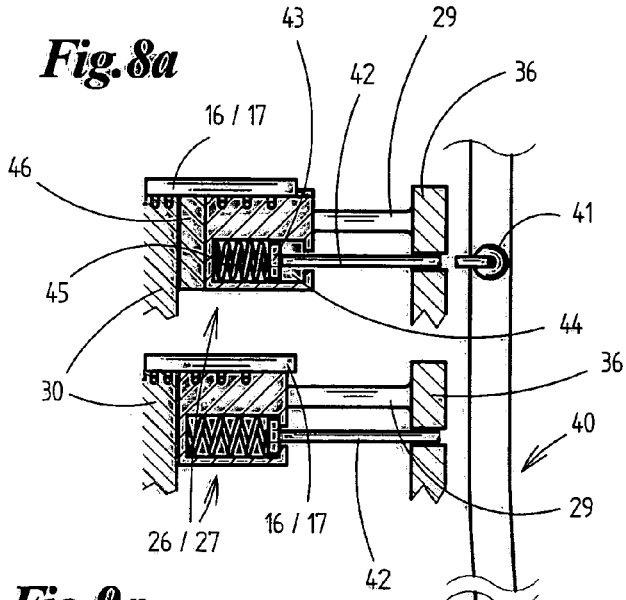
Figure 8B:
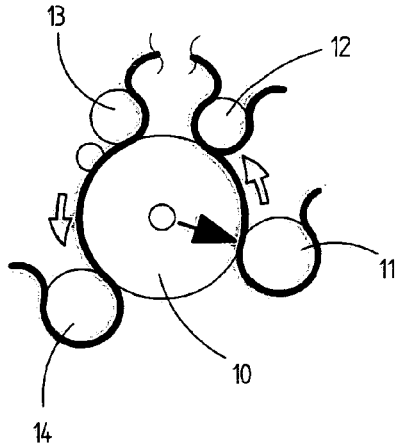
Figure 9A:
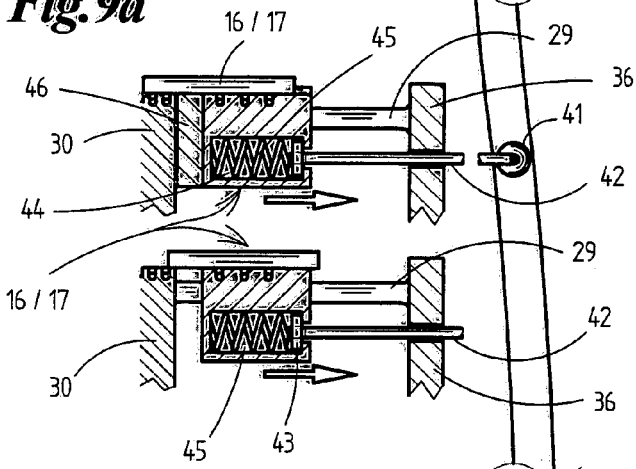
Figure 9B:
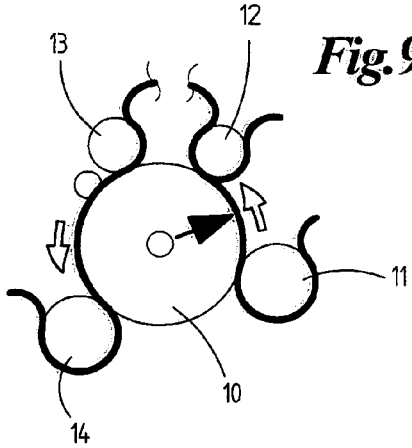
Figure 10A:
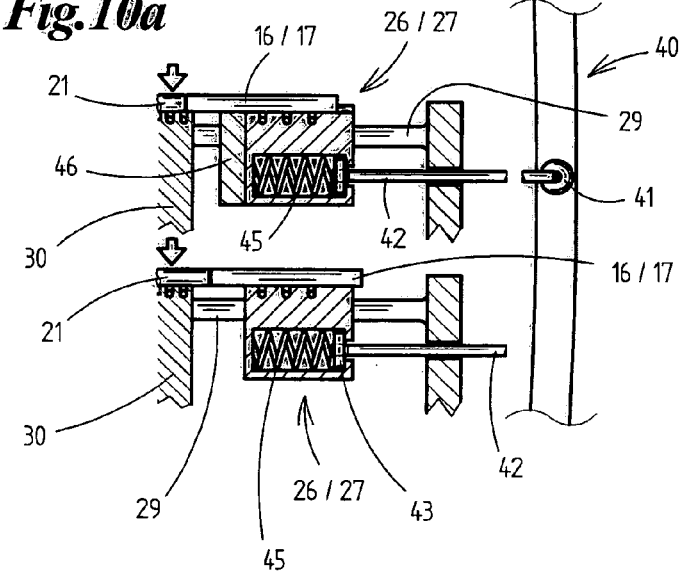
Figure 10B:
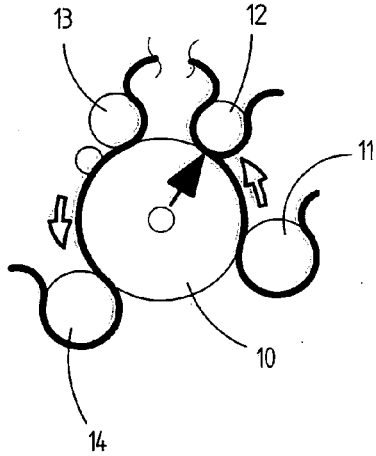

The upper illustration in each of FIG. 8*a*, FIG. 9*a*, etc. shows an alternative for the processing of shorter filter pieces 21, in other words an alternative in which a smaller gap is created between the part-rods 16, 17. This is achieved in that, in the starting position (FIG. 8*a*, top), the sliding segments 27, 28 are already displaced towards the end position. This is brought about by the insertion of a spacer 46 between the sliding segment 27, 28 on the one hand and the segment ring 30 on the other. The effect of this is that the sliding segment 27, 28, in the starting position, is at a distance apart from the segment ring 30, in other words it has already completed a first section of its movement towards the lateral end position. In this case, the sliding segments 27, 28 are also displaced relative to the bar 42 of uniform length, this occurring with compression of the compression spring 45. The tobacco rods 15 or part-rods 16, 17 are—irrespective of the length of the filter piece 21—always laid in the same position, specifically centrally relative to the segment ring 30. In the course of the subsequent movement apart of the sliding segments 27, 28, the movement operation for the lower example in each of the drawings, in other words without a spacer 46, begins immediately because the movement of the bar 42 is transmitted directly to the sliding segment 27, 28. When the spacer 46 is used, the free space within the recess 44 is first overcome during the movement of the bar 42, until the head 43 rests on the end wall of the recess 44 (FIG. 9*a*, top). At this point, in this embodiment also, the displacement of the sliding segment 27, 28 parallel to the axis begins, this movement leading to the end position shown in FIG. 10*a*. This corresponds to the position of the part-rods 16, 17 for the insertion of the filter piece 21. As is apparent, a shorter distance is created in the upper illustration than in the lower embodiment without a spacer 46.

Figure 11A:
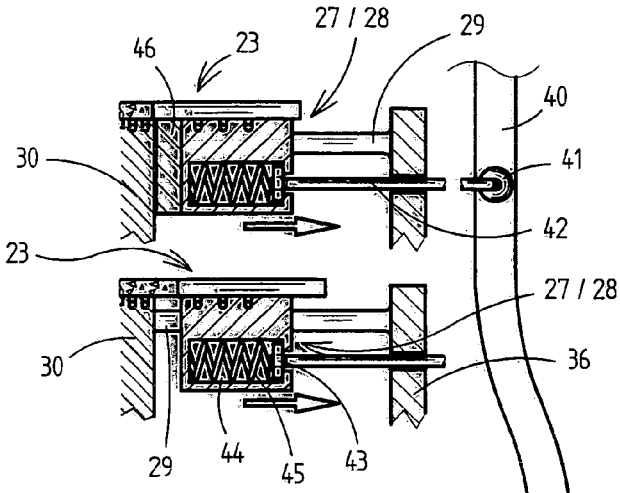
Figure 11B:
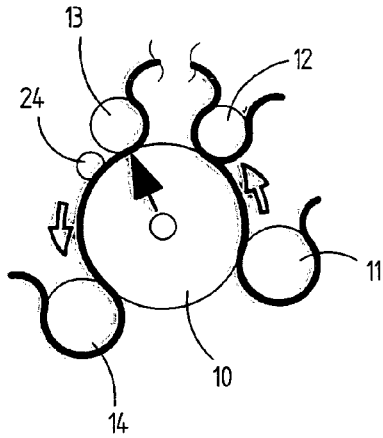
Figure 12A:
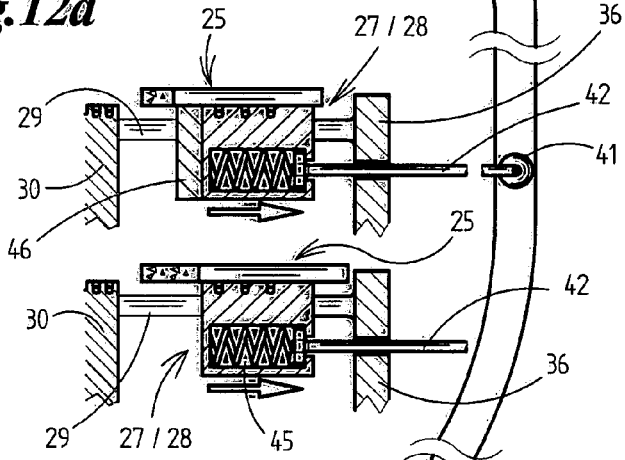
Figure 12B:
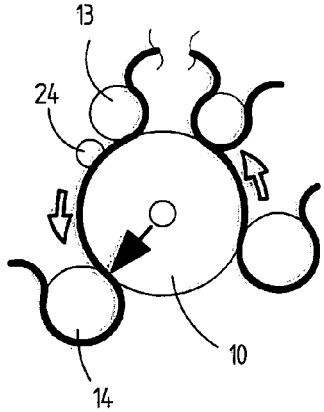
Figure 13A:
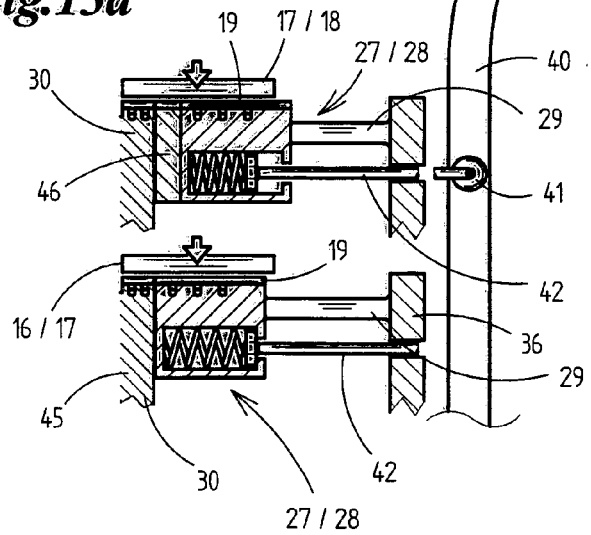
Figure 13B:
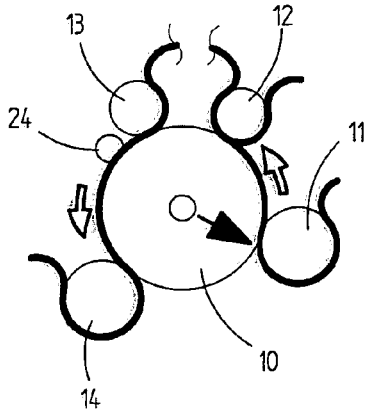

The movements following the return of the cigarette units 23 to the main cylinder 10 take place in a similar manner. The upper illustration in each of FIG. 11*a*, FIG. 12*a* and FIG. 13*a* shows the embodiment with a spacer 46, in other words with a shorter filter piece 21 or shorter filter 26. In FIG. 11*a*, specifically in the region where the cigarette units 23 finished elsewhere are received, the sliding segments 27, 28 are located in the same position, this being caused by an appropriate configuration of the control groove 40. After the severing cut in the region of the filter piece 21, the filter-tipped cigarettes 25 formed are moved apart as far as the end position shown in FIG. 12*a*. In this case, the filter-tipped cigarettes 25 are at the same distance apart from one another—irrespective of the length of the filter 26. After the filter-tipped cigarettes 25 have been taken over by the removal cylinder 14, the sliding segments 27, 28 are moved back into the starting position to take over tobacco rods 15 or part-rods 16, 17, as shown in FIG. 13*a*. The sliding segments 27, 28 provided with the spacer 46 are in this case moved by the bar 42 only until the spacer 46 comes to rest on the segment ring 30. The further displacement of the bar 42 is absorbed by the compression spring 45 (FIG. 13*a*, top).

Figure 17:
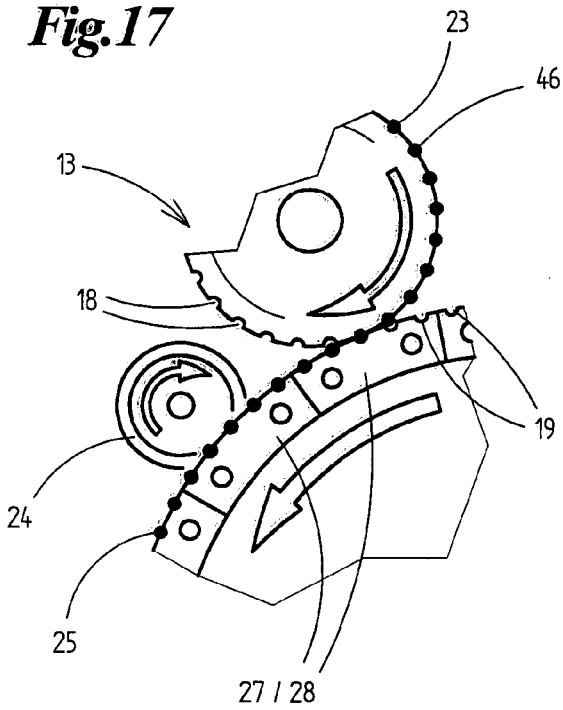
Figure 16:
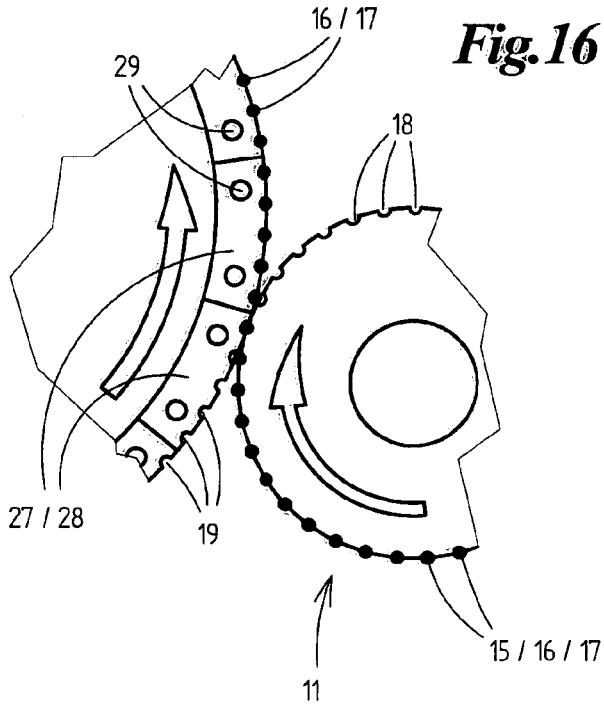

In this solution for adaptation to different dimensions of cigarettes or filter pieces 21, the main cylinder 10 and the sliding segments 27, 28 are configured with the same trough division as the assigned cylinders, in other words the feed cylinder 11, the filter cylinder 12, etc. The sliding segments 27, 28 merely exhibit segment troughs 19 at the same distance apart as the troughs 18 (FIG. 16, FIG. 17).

List of reference numerals:

| | |
|---|---|
| 10 | Main cylinder |
| 11 | Feed cylinder |
| 12 | Filter cylinder |
| 13 | Return cylinder |
| 14 | Removal cylinder |
| 15 | Tobacco rod |
| 16 | Part-rod |
| 17 | Part-rod |
| 18 | Trough |
| 19 | Segment trough |
| 20 | Segment trough |
| 21 | Filter piece |
| 22 | Wrapping paper |
| 23 | Cigarette unit |
| 24 | Severing blade |
| 25 | Filter-tipped cigarette |
| 26 | Filter |
| 27 | Sliding segment |
| 28 | Sliding segment |
| 29 | Support bar |
| 30 | Segment ring |
| 31 | Drilled hole |
| 32 | Annular trough |
| 33 | Drilled hole |
| 34 | Groove |
| 35 | Spacer bolt |
| 36 | Support ring |
| 37 | Fixed ring |
| 38 | Spacer piece |
| 39 | Cut-out |
| 40 | Control groove |
| 41 | Roller |
| 42 | Bar |
| 43 | Head |
| 44 | Recess |
| 45 | Compression spring |
| 46 | Spacer |

What is claimed is:

1. Method for the production of filter-tipped cigarettes (25) from tobacco rods (15), which are severed centrally to produce part-rods (16, 17), the part-rod (16, 17) being moved apart, and being connected by means of wrapping paper (22) to a filter piece (21) and cigarette units (23) thus formed being severed centrally in the region of the filter piece (21), characterized by the following features:

a) the tobacco rods (15) or the part-rods (16, 17) are fed to a central main cylinder (10) and transported by the latter, b) the part-rods (16, 17) are moved to a distance apart from one another by axial displacement during transportation on the main cylinder (10), c) filter pieces (21) are fed to the main cylinder (10) by a filter cylinder (2) disposed adjacently to the main cylinder (10) and are inserted into a gap formed between the part-rods (16, 17), d) the two mutually assigned part-rods (16, 17), each with one filter piece (21), are removed from the main cylinder (10) and transported outside he region there of, during which they are joined together and connected to one another by means of wrapping paper, e) cigarette units (23) thus formed are returned to the main cylinder (10) and, during further transportation on the main cylinder (10), are severed centrally in the region of the filter piece (21), and f) the filter-tipped cigarettes (25) thus formed are displaced in the longitudinal direction during the further transportation by the main cylinder (10), a distance being formed between them, and are then removed from the main cylinder.

2. Method for the production of filter-tipped cigarettes (25) from tobacco rods (15) that are severed centrally to produce two part-rods (16, 17), wherein the two part-rods (16, 17) are moved apart and connected by means of wrapping paper (22) to a filter piece (21), and cigarette units (23) thus formed being severed centrally in the region of the filter piece (21), comprising the steps of;

a) feeding the tobacco rods (15) or the two part-rods (16, 17) to a central main cylinder (10) and using the main cylinder (10) to transport the two part-rods (16, 17);

b) moving the two part-rods (16, 17) a distance apart from one another by axial displacement during transportation on the main cylinder (10), thus forming a gap between the two part-rods (16, 17);

c) feeding the filter pieces (21) to the main cylinder (10) by a filter cylinder (12) disposed adjacently to the main cylinder (10) and inserting one of the filter pieces (21) into the gap formed between the two part-rods (16, 17)

d) removing the two part-rods (16, 17), along with the filter piece (21) inserted into the gap, from the main cylinder (10) and transporting the two part-rods (16, 17) and the filter piece (21) away from the main cylinder (10), during which the two part-rods (16, 17) and the filter piece (21) are joined together and connected to one another by means of wrapping paper to form cigarette units;

e) returning the cigarette units (23) thus formed to the main cylinder (10) and, during further transportation on the main cylinder (10), severing the cigarette units (23) centrally in the region of the filter piece (21) to form filter-tipped cigarettes (25); and f) displacing the filter-tipped cigarettes (25) from each other a set distance in the longitudinal direction during the further transportation by the main cylinder (10), and then removing the filter-tipped cigarettes (25) from the main cylinder (10).

3. Apparatus for the production of filter-tipped cigarettes (25) from part-rods (16, 17) formed from centrally severed tobacco rods (15), a filter piece (21), and a wrapping paper so as to form a cigarette unit (23), comprising:

a) a main cylinder (10) having a circumference on which segment troughs (19, 20) are located, the segment troughs (19, 20) serving to receive the tobacco rods (15), the part-rods (16, 17), the filter pieces (21), the cigarette units (23), and the filter-tipped cigarettes (25), wherein the segment troughs (19, 20) are located on the main cylinder (10) in a mutually facing, adjacent position a plurality of the segment troughs (19, 20) are combined as an axial-displaceable sliding segment (27, 28), with two of the sliding segments disposed adjacently to one another in the axial direction;

the tobacco rods (15) are fed to the segment troughs (19, 20) and are severed centrally in the region of the main cylinder (10) to form the part-rods (16, 17);

after the rods (16) have been severed, the sliding segments (27, 28) are moved apart from each other such that the gap, for receiving the filter piece (21) fed from the main cylinder (10), is formed between adjacent part-rods (16, 17); and the main cylinder (10) is provided centrally with a circumferential, fixed segment ring (30), which comprises annular troughs (32) extending the segment troughs (19, 20) of the sliding segments (27, 28), the sliding segments (27, 28), in a starting position, resting on either side of the segment ring (30), in a manner such that continuous, oriented troughs are formed by the sliding segments (27, 28) and the segment ring (30), b) a filter cylinder (12) for removing the two part-rods (16, 17) with the filter piece (21) from the main cylinder (10) and the sliding segments (27, 28);

bringing together the two part-rods (16, 17) and the filter piece (21) outside of the main cylinder (10); and joining together the two part-rods (16, 17) and the filter piece (21) by a wrapping paper (22) to form the cigarette unit (23); and c) a return cylinder (13) for returning the cigarette units (23) to the main cylinder (10), wherein after the two part-rods (16, 17) and the filter piece (21) have been removed from the main cylinder (10) and the sliding segments (27, 28), the sliding segments (27, 28) are returned to their previous position, in which they are disposed adjacently to one another in the axial direction, for receiving the cigarette unit (23) formed outside of the main cylinder (10) in the filter cylinder (12);

the filter piece (21) is severed centrally in the region of the main cylinder (10 to form two filter-tipped cigarettes lying adjacent to one another in the axial direction; and the sliding segments (27, 28) are moved apart in the axial direction for separating the formed filter cigarettes (25).

4. Apparatus according to claim 3, wherein the part-rods (16, 17) are movable apart in a sideways direction parallel to the axis by a distance approximately corresponding to the length of the filter piece (21) to be inserted.

5. Apparatus according to claim 4, wherein he sideways movement, parallel to the axis, of the sliding segments (27, 28) and/or of the part-rods (16, 17) contained in the segment troughs (19, 20) of the sliding segments (27, 28) is determined by stops.

6. Apparatus according to claim 5, wherein each of the segment troughs (19) charged with a part-rod (16, 17) is assigned a stop on the circumference of the cylinder or main cylinder (10), the stop being a spacer bolt (35), which is mounted parallel to the axis and stationary, and enters into the segment trough (19, 20) with a part-region to limit the sideways movement of the part-rods (16, 17) in a manner such that an end position of the part-rods (16, 17) is determined independently of the amplitude of movement of the sliding segments (27, 28).

7. Apparatus according to claim 6, wherein the spaces between the segment troughs (19, 20) of the main cylinder (10) are half as great as the spaces between the troughs (18) on the circumference of assigned cylinders (11, 12, 13, 14), the troughs being oriented relative to one another in a manner such that the tobacco rods (15) or part-rods (16, 17) can be laid down by the feed cylinder (11) in every second segment trough (19) of the main cylinder (10) and the spacer bolts (35) are assigned to these segment troughs (19) and, moreover, the cigarette units (23) are laid down by the return cylinder (13) in the respective other troughs or segment troughs (20), in a manner such that the filter-tipped cigarettes (25) formed from the cigarettes units (23) are displaceable offset to the spacer bolts (35).

8. Apparatus according to claim 5, wherein the position of the stops is adjustable in a manner such that a displaceable support for the spacer bolts (35), the displaceable support being a support ring (36), is displaceable with the insertion of a spacer piece (38).

9. Apparatus according to claim 4, wherein the amplitude of movement of the sliding segments (27, 28) is controllable in order to produce gaps of different lengths between the part-rods (16, 17) assigned to one another, in a manner such that the sliding segments (27, 28) are adjustable relative to an actuating member, the actuating member being a bar (42), controlled by cams, so that, with a constant amplitude of movement of the actuating member, the amplitude of movement of the sliding segments (27, 28) are different.

10. Apparatus according to claim 9, wherein the actuating member is connected via an adjustable connection to the assigned sliding segment (27, 28) by the introduction of a thickened portion or a head (43) of the bar (42) into a recess (44) of the sliding segment (27, 28), the actuating member being constantly urged into a starting position by a compression spring (45).

11. Apparatus according to claim 10, wherein, in order to change the position of the sliding segments (27, 28) relative to the actuating member the sliding segment (27, 25) is adjusted by a spacer (46) relative to the bar (42) with a corresponding adjustment of the head (43) when the compression spring (45) is compressed, the spacer (46) being positioned between the sliding segment (27, 28) and the segment ring (30) in the starting position.

12. Apparatus according to claim 3, wherein the part-rods (16, 17) are movable apart in a sideways direction parallel to the axis by a distance approximately corresponding to the length of the filter piece (21) to be inserted.

13. Apparatus according to claim 12, wherein the sideways movement, parallel to the axis, of the sliding segments (27, 28) and/or of the part-rods (16, 17) contained in the segment troughs (19, 20) of the sliding segments (27, 28)is determined by stops.

14. Apparatus according to claim 13, wherein each of the segment troughs (19) charged with a part-rod (16, 17) is assigned a stop on the circumference of the cylinder or main cylinder (10), the stop being a spacer bolt (35), which is mounted parallel to the axis and stationary, and enters into the segment trough (19, 20) with a part-region to limit the sideways movement of the part-rods (16, 17) in a manner such that an end position of the part-rods (16, 17) is determined independently of the amplitude of movement of the sliding segments (27, 28).

15. Apparatus according to claim 14, wherein the spaces between the segment troughs (19, 20) of the main cylinder (10) are half as great as the spaces between the troughs (18) on the circumference of assigned cylinders 11, 12, 13, 14), the troughs being oriented relative to one another in a manner such that the tobacco rods (15) or part-rods (16, 17) can be laid down by the feed cylinder (11) in every second segment trough (19) of the main cylinder (10) and the spacer bolts (35) are assigned to these segment troughs (19) and, moreover, the cigarette units (23) are laid down by the return cylinder (13) in the respective other troughs or segment troughs (20), in a manner such that the filter-tipped cigarettes (25) formed from the cigarette units (23) are displaceable offset to the spacer bolts (35).

16. Apparatus according to claim 13, wherein the position of the stops is adjustable in a manner such that a displaceable support for the spacer bolts (35), the displaceable support being a support ring (36), is displaceable with the insertion of a spacer piece (38).

17. Apparatus according to claim 12, wherein the amplitude of movement of the sliding segments (27, 28) is controllable in order to produce gaps of different lengths between the part-rods (16, 17) assigned to are another in a manner such that the sliding segments (27, 28) are adjustable relative to an actuating member, the actuating member being a bar (42), controlled by cams, so that, with a constant amplitude of movement of the actuating member or bar (42), the amplitudes of movement of the sliding segments (27, 28) are different.

18. Apparatus according to claim 17, wherein the actuating member is connected via an adjustable connection to the assigned sliding segment (27, 28) by the introduction of a thickened portion or a head (43) of the bar (42) into a recess (44) of the sliding segment (27, 28), the actuating member being constantly urged into a starting position by a compression spring (45).

19. Apparatus according to claim 17, wherein, in order to change the position of the sliding segments (27, 28) relative to the actuating member the sliding segment (27, 28) is adjusted by a spacer (46) relative to the bar (42) with a corresponding adjustment of the head (43) when the compression spring (45) is compressed, the spacer (46) being positioned between the sliding segment (27, 28) and the segment ring (30) in the starting position.

* * * * *